US011015558B2

(12) United States Patent
Perry

(10) Patent No.: US 11,015,558 B2
(45) Date of Patent: May 25, 2021

(54) COMBINATION OUTLET VALVE AND PRESSURE RELIEF VALVE AND FUEL PUMP USING THE SAME

(71) Applicant: DELPHI TECHNOLOGIES IP LIMITED, St. Michael (BB)

(72) Inventor: Robert B. Perry, Leicester, NY (US)

(73) Assignee: DELPHI TECHNOLOGIES IP LIMITED

( * ) Notice: Subject to any disclaimer, the term of this patent is extended or adjusted under 35 U.S.C. 154(b) by 22 days.

(21) Appl. No.: 16/277,492

(22) Filed: Feb. 15, 2019

(65) Prior Publication Data

US 2020/0263646 A1 Aug. 20, 2020

(51) Int. Cl.

| | |
|---|---|
| ***F02M 59/36*** | (2006.01) |
| ***F02M 59/02*** | (2006.01) |
| ***F02M 59/46*** | (2006.01) |
| ***F02M 63/02*** | (2006.01) |
| ***F04B 49/22*** | (2006.01) |

(52) U.S. Cl.

CPC ..... *F02M 59/36* (2013.01); *F02M 59/027* (2013.01); *F02M 59/361* (2013.01); *F02M 59/462* (2013.01); *F02M 63/0265* (2013.01); *F04B 49/22* (2013.01); *F02M 2200/50* (2013.01)

(58) Field of Classification Search

CPC ..... F02M 59/36; F02M 59/366–368; F02M 59/46; F02M 59/462; F04B 49/22; F04B 49/225; F04B 49/24; F04B 49/246; F04B 53/10; F04B 53/1002; F04B 53/1087; F04B 53/109; F04B 53/1092; F16K 17/0473; F16K 17/48

USPC ..... 123/510

See application file for complete search history.

(56) References Cited

U.S. PATENT DOCUMENTS

| | | | | |
|---|---|---|---|---|
| 1,933,454 | A * | 10/1933 | Sidney | F04B 53/10 137/493.3 |
| 4,099,894 | A * | 7/1978 | Indra | F02M 59/462 137/538 |
| 4,467,767 | A | 8/1984 | Kampichler et al. | |
| 4,577,606 | A | 3/1986 | Boehringer et al. | |
| 4,834,134 | A | 5/1989 | Asami et al. | |

(Continued)

FOREIGN PATENT DOCUMENTS

| | | | |
|---|---|---|---|
| JP | 2013167259 | A | 8/2013 |
| JP | 2014136973 | A | 7/2014 |

*Primary Examiner* — Carl C Staubach
*Assistant Examiner* — Robert A Werner
(74) *Attorney, Agent, or Firm* — Joshua M. Haines

(57) ABSTRACT

A combination outlet valve and pressure relief valve includes an outer housing having a passage. An inner housing is located within the passage and includes a first bore extending thereinto from one end and a second bore extending thereinto from the other end such that the first bore and the second bore terminate at an inner housing wall. An outlet valve assembly is located within the first bore and includes an outlet valve member, an outlet valve seat, and an outlet valve spring grounded to the inner housing wall and biasing the outlet valve member toward the outlet valve seat. A pressure relief valve assembly is located within the second bore and includes a pressure relief valve member, a pressure relief valve seat, and a pressure relief valve spring grounded to the inner housing wall and biasing the pressure relief valve member toward the pressure relief valve seat.

20 Claims, 11 Drawing Sheets

(56) References Cited

U.S. PATENT DOCUMENTS

| | | | | |
|---|---|---|---|---|
| 4,926,902 | A | 5/1990 | Nakamura et al. | |
| 5,839,414 | A * | 11/1998 | Klinger | F02M 59/462 123/467 |
| 7,086,388 | B2 | 8/2006 | Roth et al. | |
| 7,267,108 | B2 | 9/2007 | Barylski et al. | |
| 8,132,558 | B2 * | 3/2012 | Lucas | F02M 59/366 123/510 |
| 9,181,944 | B2 * | 11/2015 | Kuroyanagi | F04B 49/035 |
| 9,409,652 | B2 * | 8/2016 | Espinosa Sanchez | B64D 39/06 |
| 9,644,585 | B2 * | 5/2017 | Lucas | F02M 59/367 |
| 9,683,559 | B2 * | 6/2017 | Usui | F02M 63/005 |
| 9,828,958 | B2 * | 11/2017 | Saito | F02M 55/04 |
| 9,989,050 | B2 | 6/2018 | Asayama et al. | |
| 10,030,650 | B2 | 7/2018 | Kuroyanagi et al. | |
| 2014/0314605 | A1 * | 10/2014 | Koga | F02M 37/0023 417/568 |
| 2015/0078922 | A1 * | 3/2015 | Oikawa | F04B 1/0452 417/213 |
| 2015/0203210 | A1 * | 7/2015 | Espinosa Sanchez | B64D 39/06 137/505 |
| 2016/0010607 | A1 | 1/2016 | Lucas | |
| 2018/0291855 | A1 | 10/2018 | Mikhaylov et al. | |
| 2019/0017481 | A1 * | 1/2019 | Scheller | F02M 59/46 |

* cited by examiner

COMBINATION OUTLET VALVE AND PRESSURE RELIEF VALVE AND FUEL PUMP USING THE SAME

TECHNICAL FIELD OF INVENTION

The present invention relates to a combination outlet valve and pressure relief valve and a fuel pump using the combination outlet valve and pressure relief valve which supplies fuel to an internal combustion engine.

BACKGROUND OF INVENTION

Fuel systems in modern internal combustion engines fueled by gasoline, particularly for use in the automotive market, employ gasoline direct injection (GDi) where fuel injectors are provided which inject fuel directly into combustion chambers of the internal combustion engine. In such systems employing GDi, fuel from a fuel tank is supplied under relatively low pressure by a low-pressure fuel pump which is typically an electric fuel pump located within the fuel tank. The low-pressure fuel pump supplies the fuel to a high-pressure fuel pump which typically includes a pumping plunger which is reciprocated by a camshaft of the internal combustion engine. Reciprocation of the pumping plunger further pressurizes the fuel in a pumping chamber of the high-pressure fuel pump in order to be supplied to fuel injectors which inject the fuel directly into the combustion chambers of the internal combustion engine. An outlet valve is typically included in an outlet passage of the high-pressure fuel pump where the outlet valve prevents flow of fuel back into the pumping chamber during an intake stroke of the pumping plunger. Additionally, a pressure relief valve is known to be provided to allow fuel to flow back into pumping chamber if the pressure downstream of the high-pressure fuel pump exceeds a predetermined level which may result in unsafe operating conditions. In some known arrangements, such as in U.S. Pat. No. 9,828,958 to Saito and in U.S. Pat. No. 9,644,585 to Lucas, the outlet valve and pressure relief valve are combined into a single component. However, in such known arrangements, springs which bias an outlet valve member and which bias a pressure relief valve member are grounded by separate members which may lead to complexity and cost in manufacturing and the need for specialized seats for the outlet valve and for the pressure relief valve which adds to cost.

What is needed is a fuel pump and a combination outlet valve and pressure relief valve which minimize or eliminate one or more of the shortcomings as set forth above and provide an alternative for fuel systems.

SUMMARY OF THE INVENTION

Briefly described, a combination outlet valve and pressure relief valve is provided by the present invention for controlling outlet fuel flow of a fuel pump and for relieving over-pressurization downstream of the fuel pump. The combination outlet valve and pressure relief includes an outer housing having an outer housing passage extending therethrough from an outer housing inlet to an outer housing outlet; an inner housing located within the outer housing passage and extending along an inner housing axis from an inner housing first end face to an inner housing second end face, the inner housing having an outlet valve bore extending thereinto from the inner housing first end face and also having a pressure relief valve bore extending thereinto from the inner housing second end face such that the outlet valve bore and the pressure relief valve bore terminate at an inner housing wall which is traverse to the inner housing axis; an outlet valve assembly located within the outlet valve bore and comprising an outlet valve member, an outlet valve seat, and an outlet valve spring, the outlet valve member being moveable between 1) a seated position which prevents fluid communication between the outer housing inlet and the outer housing outlet through the outlet valve seat and 2) an unseated position which permits fluid communication between the outer housing inlet and the outer housing outlet through the outlet valve seat, the outlet valve spring being grounded to the inner housing wall and biasing the outlet valve member toward the seated position; and a pressure relief valve assembly located within the pressure relief valve bore and comprising a pressure relief valve member, a pressure relief valve seat, and a pressure relief valve spring, the pressure relief valve member being moveable between 1) a seated position which prevents fluid communication between the outer housing outlet and the outer housing inlet through the pressure relief valve seat and 2) an unseated position which permits fluid communication between the outer housing outlet and the outer housing inlet through the pressure relief valve seat, the pressure relief valve spring being grounded to the inner housing wall and biasing the pressure relief valve member toward the seated position. A fuel pump which includes the aforementioned combination outlet valve and pressure relief valve is also provided by the present invention. The combination outlet valve and pressure relief valve and fuel pump including the combination outlet valve and pressure relief valve of the present invention provides for simplified construction.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
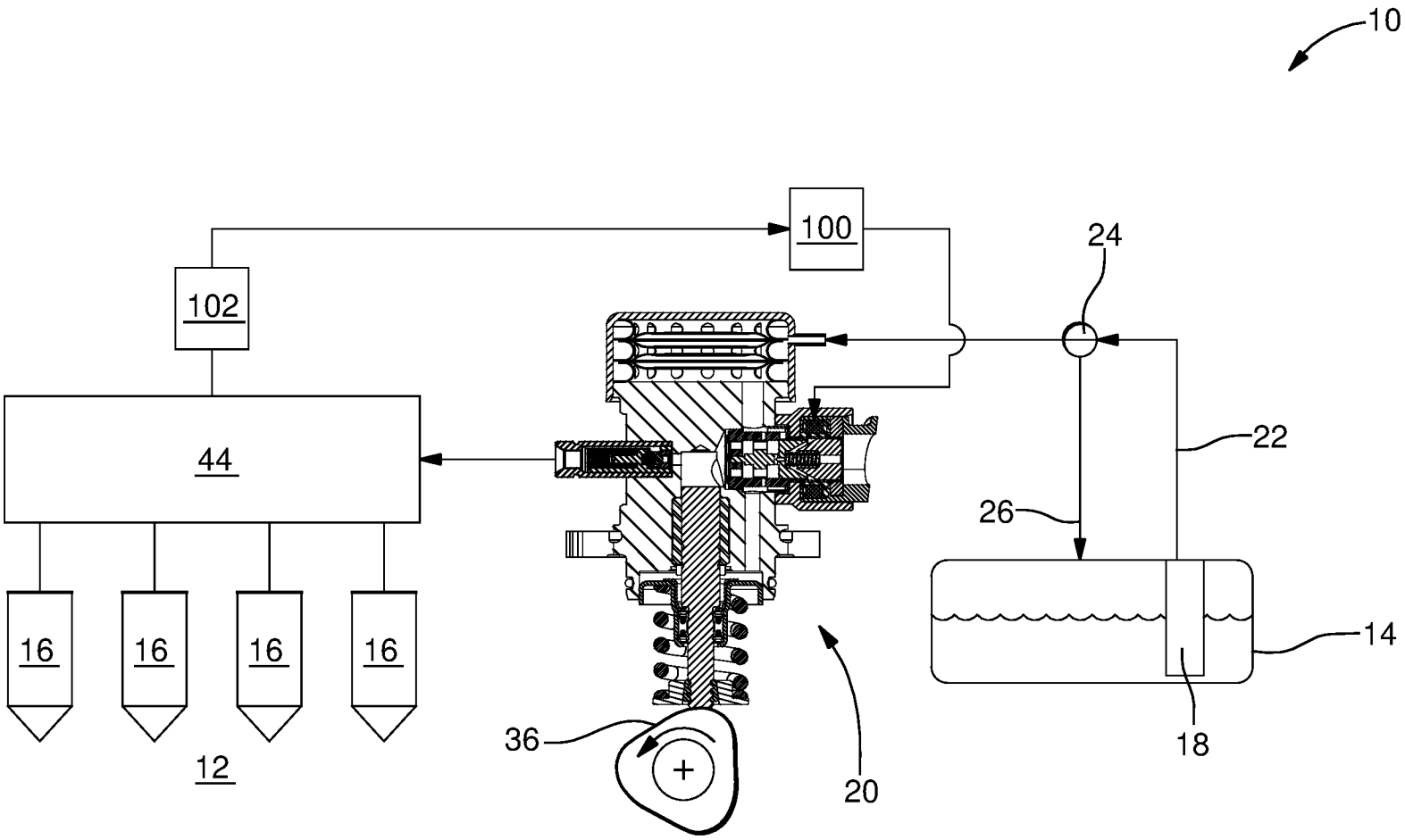
FIG. 1 is a schematic view of a fuel system including a fuel pump in accordance with the present invention.

In accordance with a preferred embodiment of this invention and referring initially to FIG. 1, a fuel system 10 for an internal combustion engine 12 is shown is schematic form. Fuel system 10 generally includes a fuel tank 14 which holds a volume of fuel to be supplied to internal combustion engine 12 for operation thereof; a plurality of fuel injectors 16 which inject fuel directly into respective combustion chambers (not shown) of internal combustion engine 12; a low-pressure fuel pump 18; and a high-pressure fuel pump 20 where the low-pressure fuel pump 18 draws fuel from fuel tank 14 and elevates the pressure of the fuel for delivery to high-pressure fuel pump 20 where the high-pressure fuel pump 20 further elevates the pressure of the fuel for delivery to fuel injectors 16. By way of non-limiting example only, low-pressure fuel pump 18 may elevate the pressure of the fuel to about 500 kPa or less and high-pressure fuel pump 20 may elevate the pressure of the fuel to above about 14 MPa. While four fuel injectors 16 have been illustrated, it should be understood that a lesser or greater number of fuel injectors 16 may be provided.

As shown, low-pressure fuel pump 18 may be provided within fuel tank 14, however low-pressure fuel pump 18 may alternatively be provided outside of fuel tank 14. Low-pressure fuel pump 18 may be an electric fuel pump as are well known to a practitioner of ordinary skill in the art. A low-pressure fuel supply passage 22 provides fluid communication from low-pressure fuel pump 18 to high-pressure fuel pump 20. A fuel pressure regulator 24 may be provided such that fuel pressure regulator 24 maintains a substantially uniform pressure within low-pressure fuel supply passage 22 by returning a portion of the fuel supplied by low-pressure fuel pump 18 to fuel tank 14 through a fuel return passage 26. While fuel pressure regulator 24 has been illustrated in low-pressure fuel supply passage 22 outside of fuel tank 14, it should be understood that fuel pressure regulator 24 may be located within fuel tank 14 and may be integrated with low-pressure fuel pump 18.

Figure 2:
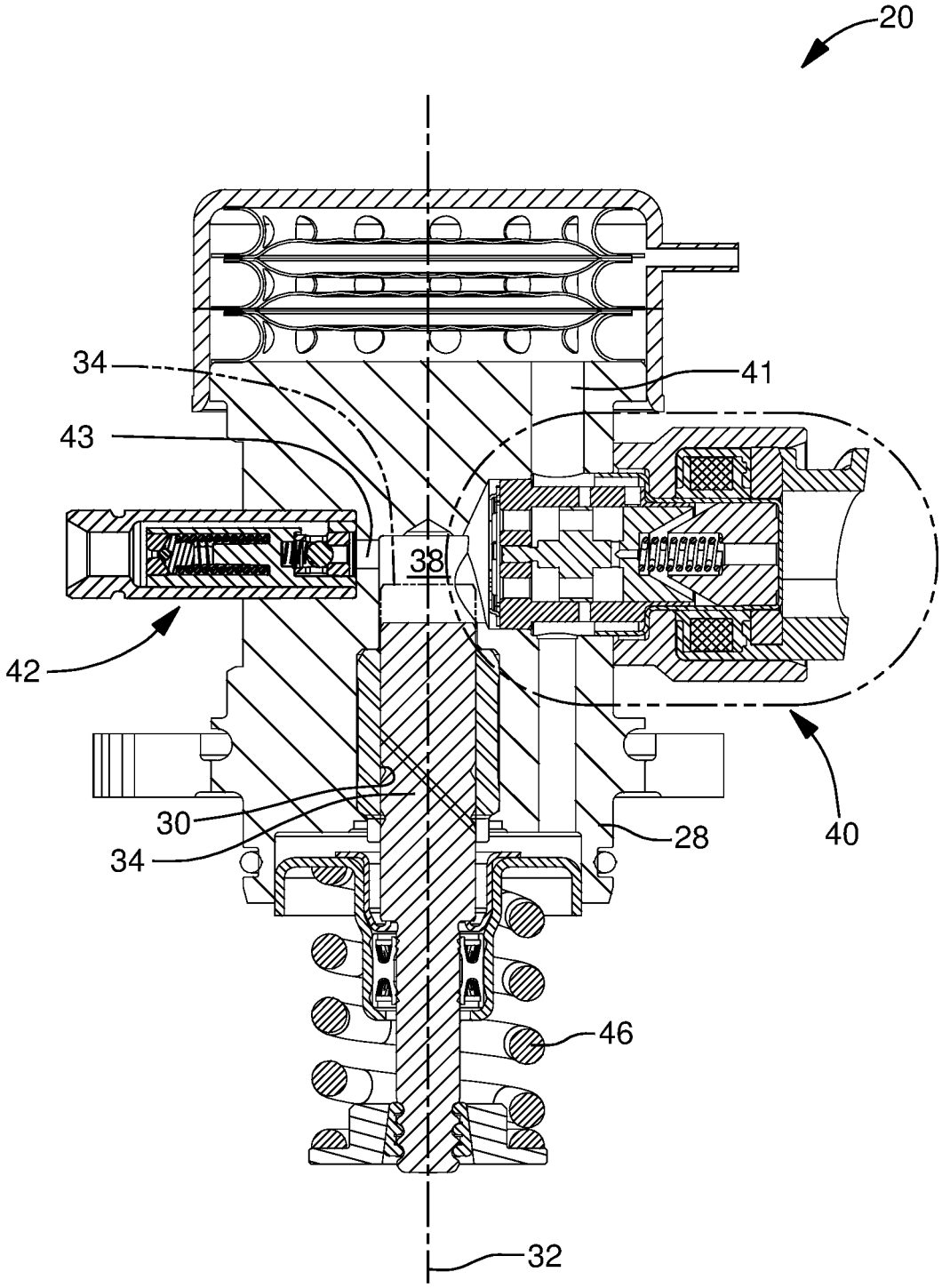
FIG. 2 is a cross-sectional view of the fuel pump of FIG. 1.
Figure 3:
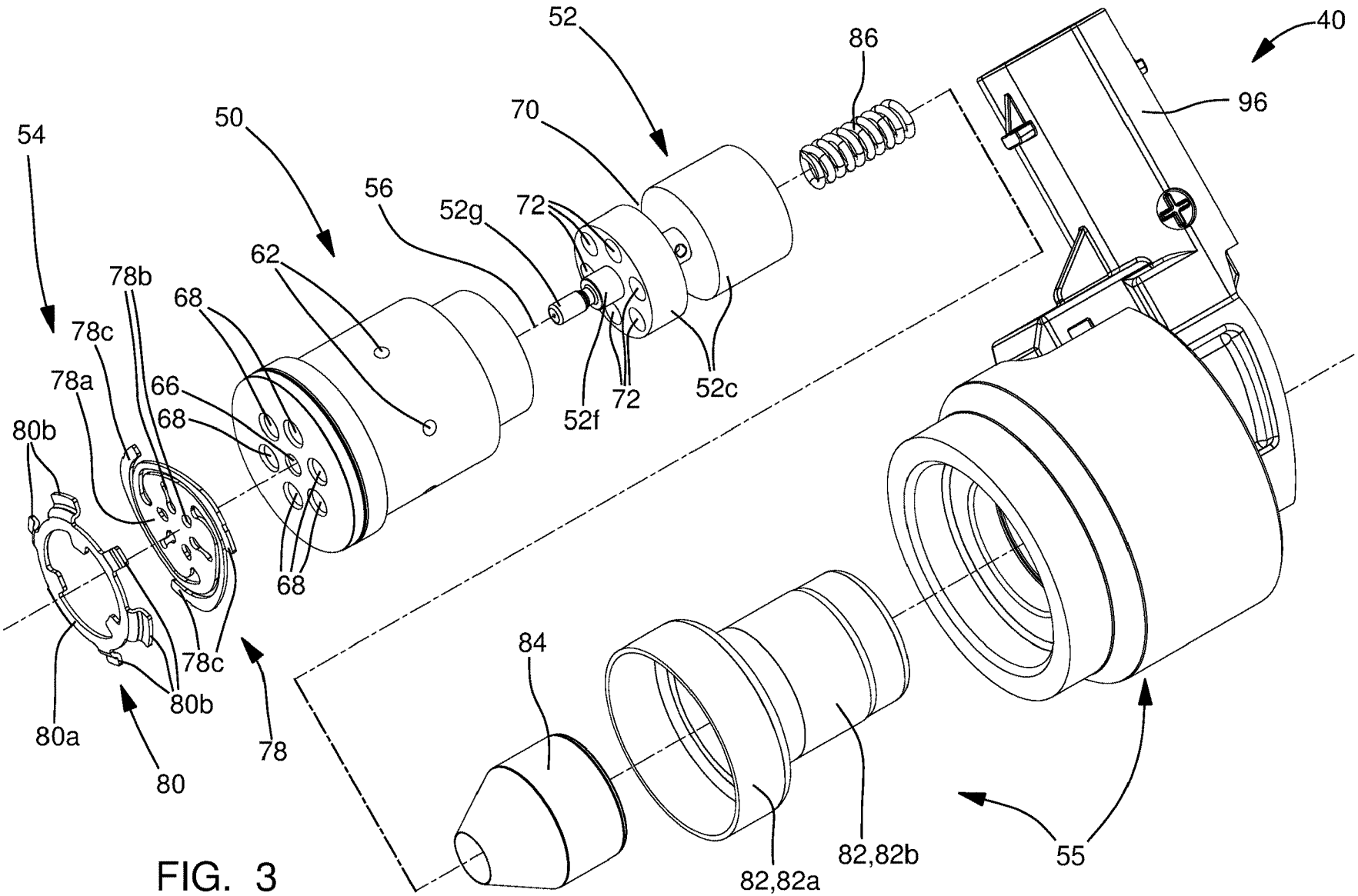
FIG. 3 is an exploded isometric view of an inlet valve assembly of the fuel pump of FIGS. 1 and 2.

Now with additional reference to FIG. 2, high-pressure fuel pump 20 includes a fuel pump housing 28 which includes a plunger bore 30 which extends along, and is centered about, a plunger bore axis 32. As shown, plunger bore 30 may be defined by a combination of an insert and directly by fuel pump housing 28. High-pressure fuel pump 20 also includes a pumping plunger 34 which is located within plunger bore 30 and reciprocates within plunger bore 30 along plunger bore axis 32 based on input from a rotating camshaft 36 of internal combustion engine 12 (shown only in FIG. 1). A pumping chamber 38 is defined within fuel pump housing 28, and more specifically, pumping chamber 38 is defined by plunger bore 30 and pumping plunger 34. An inlet valve assembly 40 of high-pressure fuel pump 20 is located within a pump housing inlet passage 41 of fuel pump housing 28 and selectively allows fuel from low-pressure fuel pump 18 to enter pumping chamber 38 while a combination outlet valve and pressure relief valve 42 is located within a housing outlet passage 43 of fuel pump housing 28 and selectively allows fuel to be communicated from pumping chamber 38 to fuel injectors 16 via a fuel rail 44 to which each fuel injector 16 is in fluid communication. Combination outlet valve and pressure relief valve 42 also provides a fluid path back to pumping chamber 38 if the pressure downstream of combination outlet valve and pressure relief valve 42 reaches a predetermined limit which may pose an unsafe operating condition if left unmitigated. In operation, reciprocation of pumping plunger 34 causes the volume of pumping chamber 38 to increase during an intake stroke of pumping plunger 34 (downward as oriented in FIG. 2) in which a plunger return spring 46 causes pumping plunger 34 to move downward, and conversely, the volume of pumping chamber 38 decrease during a compression stroke (upward as oriented in FIG. 2) in which camshaft 36 causes pumping plunger 34 to move upward against the force of plunger return spring 46. In this way, fuel is selectively drawn into pumping chamber 38 during the intake stroke, depending on operation of inlet valve assembly 40 as will be described in greater detail later, and conversely, fuel is pressurized within pumping chamber 38 by pumping plunger 34 during the compression stroke and discharged through combination outlet valve and pressure relief valve 42, as will be described in greater detail later, under pressure to fuel rail 44 and fuel injectors 16. For clarity, pumping plunger 34 is shown in solid lines in FIG. 2 to represent the intake stroke and pumping plunger 34 is shown in phantom lines in FIG. 2 to represent the compression stroke. It should be noted that combination outlet valve and pressure relief valve 42 acts as a conventional a one-way valve during normal operation which allows fuel to flow from pumping chamber 38 toward fuel rail 44, but prevents flow in the opposite direction, however, acts as a pressure relief valve only when the pressure downstream of combination outlet valve and pressure relief valve 42 exceeds a predetermined pressure.

Inlet valve assembly 40 will now be described with particular reference to FIGS. 3-7. Inlet valve assembly 40 includes a valve body 50, a valve spool 52 located within valve body 50, a check valve 54, and a solenoid assembly 55. The various elements of inlet valve assembly 40 will be described in greater detail in the paragraphs that follow.

Valve body 50 is centered about, and extends along, a valve body axis 56 such that valve body 50 extends from a valve body first end 50*a* to a valve body second end 50*b*. A valve body bore 58 extends into valve body 50 from valve body first end 50*a* and terminates at a valve body end wall 60 which extends to valve body second end 50*b* such that valve body bore 58 is preferably cylindrical. A valve body first inlet passage 62 extends through valve body 50 such that valve body first inlet passage 62 extends from a valve body outer periphery 50*c* of valve body 50 and opens into valve body bore 58. A valve body second inlet passage 64 (not visible in FIG. 3, but visible in FIGS. 4-7) extends through valve body 50 such that valve body second inlet passage 64 extends from valve body outer periphery 50*c* and opens into valve body bore 58. As shown in the figures, valve body first inlet passage 62 and valve body second inlet passage 64 are spaced axially apart from each other along valve body axis 56 such that valve body second inlet passage 64 is located axially between valve body first end 50*a* and valve body first inlet passage 62. Also as shown in the figures, a plurality of valve body first inlet passages 62 may be provided such that each valve body first inlet passage 62 is located in the same axial location along valve body axis 56, however, each valve body first inlet passage 62 is spaced apart from the other valve body first inlet passages 62 around valve body outer periphery 50*c*. While only one valve body second inlet passage 64 is illustrated, it should be understood that a plurality of valve body second inlet passages 64 may be provided at the same axial location along valve body axis 56 but spaced apart from each other around valve body outer periphery 50*c*.

A valve body central passage 66 extends through valve body end wall 60 such that valve body central passage 66 connects valve body second end 50*b* with valve body bore 58 and such that valve body central passage 66 is centered about, and extends along, valve body axis 56. A plurality of valve body outlet passages 68 is provided in valve body end wall 60 such that each valve body outlet passage 68 extends through valve body end wall 60 and such that each valve body outlet passage 68 connects valve body second end 50*b* with valve body bore 58. Each valve body outlet passage 68 is laterally offset from valve body central passage 66 and extends through valve body end wall 60 in a direction parallel to valve body axis 56.

As shown in the figures, valve body outer periphery 50*c* may include three sections of distinct diameters. A valve body outer periphery first portion 50*d* of valve body outer periphery 50*c* begins at valve body first end 50*a* and extends to a valve body outer periphery second portion 50*e* of valve body outer periphery 50*c* such that valve body outer periphery first portion 50*d* is smaller in diameter than valve body outer periphery second portion 50*e*. As shown in the figures, valve body outer periphery first portion 50*d* may be located entirely outside of pump housing inlet passage 41 and valve body outer periphery second portion 50*e* includes valve body first inlet passage 62 and valve body second inlet passage 64 such that valve body first inlet passage 62 and valve body second inlet passage 64 are each in constant fluid communication with the portion of pump housing inlet passage 41 that is upstream of inlet valve assembly 40, i.e. valve body first inlet passage 62 and valve body second inlet passage 64 are each in constant fluid communication with the portion of pump housing inlet passage 41 that is between inlet valve assembly 40 and low-pressure fuel pump 18. A valve body outer periphery third portion 50*f* of valve body outer periphery 50*c* extends from valve body outer periphery second portion 50*e* to valve body second end 50*b* such that valve body outer periphery third portion 50*f* is larger in diameter than valve body outer periphery second portion 50*e*. Valve body outer periphery third portion 50*f* is sealingly engaged with pump housing inlet passage 41 such that fluid communication through pump housing inlet passage 41 past inlet valve assembly 40 at the interface of pump housing inlet passage 41 and valve body outer periphery third portion 50*f* is prevented and fluid communication through pump housing inlet passage 41 past inlet valve assembly 40 is only possible through valve body bore 58.

Valve spool 52 is made of a magnetic material and is centered about, and extends along, valve body axis 56 from a valve spool first end 52*a* to a valve spool second end 52*b*. Valve spool 52 includes a valve spool first portion 52*c* which is proximal to valve spool first end 52*a* and a valve spool second portion 52*d* which is proximal to valve spool second end 52*b*. Valve spool first portion 52*c* has a valve spool outer periphery 52*e* which is complementary with valve body bore 58 such that valve spool outer periphery 52*e* and valve body bore 58 are sized in order to substantially prevent fuel from passing between the interface of valve spool outer periphery 52*e* and valve body bore 58. As used herein, substantially preventing fuel from passing between the interface of valve spool outer periphery 52*e* and valve body bore 58 encompasses permitting small amounts of fuel passing between the interface which still allows operation of high-pressure fuel pump 20 as will readily be recognized by a practitioner of ordinary skill in the art. Valve spool second portion 52*d* includes a base portion 52*f* which extends from valve spool first portion 52*c* such that base portion 52*f* is smaller in diameter than valve spool first portion 52*c*, thereby providing an annular space radially between base portion 52*f* and valve body bore 58. Valve spool second portion 52*d* also include a tip portion 52*g* which extend from base portion 52*f* and terminates at valve spool second end 52*b*. Tip portion 52*g* is smaller in diameter than base portion 52*f*, thereby defining a valve spool shoulder 52*h* where tip portion 52*g* meets base portion 52*f*. Tip portion 52*g* is sized to be located within valve body central passage 66 of valve body 50 such that tip portion 52*g* is able to slide freely within valve body central passage 66 in the direction of valve body axis 56. In use, tip portion 52*g* is used to interface with check valve 54 as will be described in greater detail later.

Valve spool first portion 52*c* is provided with a valve spool groove 70 which extends radially inward from valve spool outer periphery 52*e* such that valve spool groove 70 is annular in shape. Valve spool groove 70 is selectively aligned or not aligned with valve body first inlet passage 62 and valve body second inlet passage 64 in order to control fluid communication through pump housing inlet passage 41 as will be described in greater detail later. One or more valve spool passages 72 is provided which extend from valve spool groove 70 through valve spool first portion 52*c* toward valve spool second end 52*b*, thereby providing fluid communication between valve spool groove 70 and valve body outlet passages 68.

A valve spool end bore 74 extends into valve spool 52 from valve spool first end 52*a*. As shown, valve spool end bore 74 may include a valve spool end bore first portion 74*a* which is an internal frustoconical shape and a valve spool end bore second portion 74*b* which is cylindrical and terminates with a valve spool end bore bottom 74*c*. A valve spool connecting passage 76 provides fluid communication between valve spool groove 70 and valve spool end bore 74 such that, as shown in the figures, valve spool connecting passage 76 may be formed, by way of non-limiting example only, by a pair of perpendicular drillings.

Check valve 54 includes a check valve member 78 and a travel limiter 80. Check valve 54 is arranged at valve spool second end 52*b* such that check valve member 78 is moved between a seated position which blocks valve body outlet passages 68 (shown in FIGS. 5-7) and an open position which unblocks valve body outlet passages 68 (shown in FIG. 4) as will be described in greater detail later. Check valve member 78 includes a check valve central portion 78*a* which is a flat plate with check valve passages 78*b* extending therethrough where it is noted that only select check valve passages 78*b* have been labeled in FIG. 3 for clarity. Check valve passages 78*b* are arranged through check valve central portion 78*a* such that check valve passages 78*b* are not axially aligned with valve body outlet passages 68. A plurality of check valve legs 78*c* extend from check valve central portion 78*a* such that check valve legs 78*c* are resilient and compliant. Free ends of check valve legs 78*c* are fixed to valve body second end 50*b*, for example, by welding. Consequently, when the pressure differential between valve body bore 58 and pumping chamber 38 is sufficiently high, check valve central portion 78*a* is allowed to unseat from valve spool 52 due to elastic deformation of check valve legs 78*c*, thereby opening valve body outlet passages 68. Travel limiter 80 includes a travel limiter ring 80*a* which is axially spaced apart from valve body second end 50*b* to provide the allowable amount of displacement of check valve member 78. Travel limiter 80 also includes a plurality of travel limiter legs 80*b* which provides the axial spacing between travel limiter ring 80*a* and valve body second end 50*b*. Travel limiter legs 80*b* are integrally formed with travel limiter ring 80*a* and are fixed to valve body second end 50*b*, for example by welding.

Solenoid assembly 55 includes a solenoid inner housing 82, a pole piece 84 located within solenoid inner housing 82, a return spring 86, a spool 88, a coil 90, an overmold 92, and a solenoid outer housing 94. The various elements of solenoid assembly 55 will be described in greater detail in the paragraphs that follow.

Solenoid inner housing 82 is hollow and is stepped both internally and externally such that an inner housing first portion 82*a* is open and larger in diameter than an inner housing second portion 82*b* which is closed. Solenoid inner housing 82 is centered about, and extends along valve body axis 56. The outer periphery of inner housing first portion 82*a* sealingly engages fuel pump housing 28 in order to prevent leakage of fuel from pump housing inlet passage 41 to the exterior of high-pressure fuel pump 20 and an annular gap is provided between the inner periphery of inner housing first portion 82*a* and valve body outer periphery second portion 50*e* in order to provide fluid communication between pump housing inlet passage 41 and valve body second inlet passage 64. The inner periphery of inner housing second portion 82*b* mates with valve body outer periphery first portion 50*d* to prevent communication of fuel between the interface of the inner periphery of inner housing second portion 82*b* and valve body outer periphery first portion 50*d*.

Pole piece 84 is made of a magnetically permeable material and is received within inner housing second portion 82*b* such that pole piece 84 is centered about, and extends along, valve body axis 56. A pole piece first end 84*a* is frustoconical such that the angle of pole piece first end 84*a* is complementary to the angle of valve spool end bore first portion 74*a*. In this way, pole piece first end 84*a* is received within valve spool end bore first portion 74*a*. A pole piece second end 84*b*, which is opposed to pole piece first end 84*a*, is located at the closed end of solenoid inner housing 82. A pole piece bore 84*c* extends axially through pole piece 84 from pole piece first end 84*a* to pole piece second end 84*b* such that the larger diameter portion of pole piece bore 84*c* extends into pole piece 84 from pole piece first end 84*a*, thereby defining a pole piece shoulder 84*d* which faces toward valve spool bore bottom 74*c*. Return spring 86 is received partially with pole piece bore 84*c* such that return spring 86 abuts pole piece shoulder 84*d*. Return spring 86 is also partially received within valve spool end bore second portion 74*b* and abuts valve spool end bore bottom 74*c*. Return spring 86 is held in compression between pole piece shoulder 84*d* and valve spool end bore bottom 74*c*, and in this way, return spring 86 biases valve spool 52 away from pole piece 84.

Spool 88 is made of an electrically insulative material, for example plastic, and is centered about, and extends along, valve body axis 56 such that spool 88 circumferentially surrounds inner housing second portion 82*b* in a close-fitting relationship. Coil 90 is a winding of electrically conductive wire which is wound about the outer periphery of spool 88 such that coil 90 circumferentially surrounds pole piece 84. Consequently, when coil 90 is energized with an electric current, valve spool 52 is magnetically attracted to, and moved toward, pole piece 84 and when coil 90 is not energized with an electric current, valve spool 52 is moved away from pole piece 84 by return spring 86. A more detailed description of operation will be provided later.

Solenoid outer housing 94 circumferentially surrounds solenoid inner housing 82, spool 88, and coil 90 such that spool 88 and coil 90 are located radially between solenoid inner housing 82 and solenoid outer housing 94. Overmold 92 is an electrically insulative material, for example plastic, which fills the void between spool 88/coil 90 and solenoid outer housing 94 such that overmold 92 extends axially from solenoid outer housing 94 to define an electrical connector 96 which includes terminals (not shown) that are connected to opposite ends of coil 90. Electrical connector 96 is configured to mate with a complementary electrical connector (not show) for supplying electric current to coil 90 in use. As shown, a coil washer 98 may be provided within solenoid outer housing 94 axially between coil 90 and overmold 92 in order to complete the magnetic circuit of solenoid assembly 55.

Figure 4:
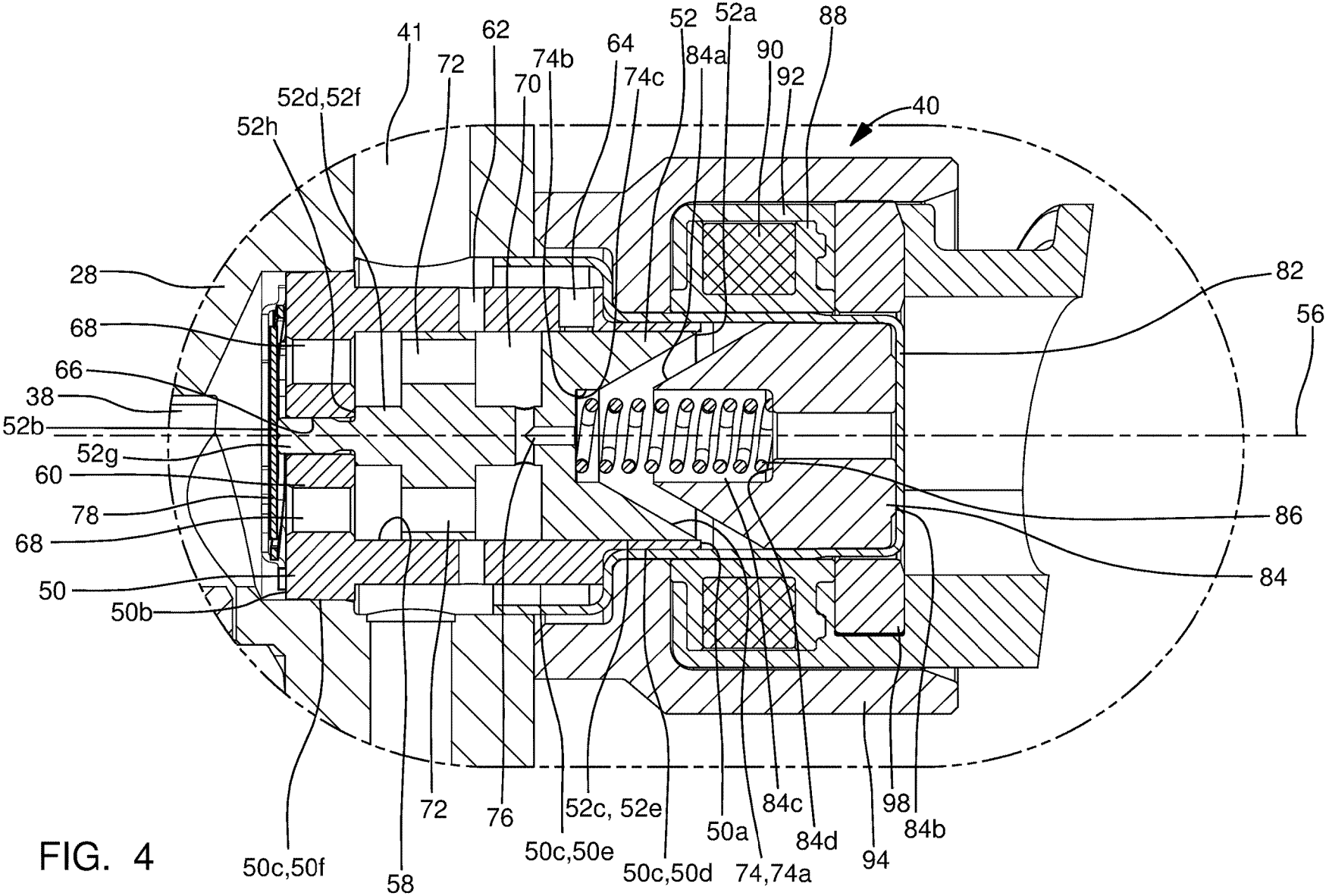
FIG. 4 is an enlargement of a portion of FIG. 2 showing the inlet valve assembly of the fuel pump in a first position.

Operation of high-pressure fuel pump 20, and in particular, inlet valve assembly 40, will now be described with particular reference to FIG. 4 which shows valve spool 52 in a first position which results from no electric current being supplied to coil 90 of solenoid assembly 55. When no electric current is supplied to coil 90, return spring 86 urges valve spool 52 away from pole piece 84 until valve spool shoulder 52*h* abuts valve body end wall 60 which allows tip portion 52*g* of valve spool 52 to protrude beyond valve body second end 50*b* such that tip portion 52*g* holds check valve member 78 in an unseated position which permits flow through valve body outlet passages 68 and such that valve body outlet passages 68 are in fluid communication with pumping chamber 38. Also in the first position, valve spool groove 70 is aligned with valve body first inlet passage 62, however, it is noted that valve spool groove 70 is not aligned with valve body second inlet passage 64. In this way, valve spool 52 maintains check valve member 78 in the unseated position and valve body first inlet passage 62 is in fluid communication with valve body outlet passages 68. It should be noted that in the first position, alignment between valve spool groove 70 and valve body first inlet passage 62 provides a path to pump housing inlet passage 41. In this way, the first position is a default position that provides limp-home operation of high-pressure fuel pump 20, that is, if electrical power to solenoid assembly 55 is unintentionally interrupted, fuel in sufficient quantity and pressure is supplied to fuel injectors 16 by low-pressure fuel pump 18 for continued operation of internal combustion engine 12, although without the fuel being pressurized by high-pressure fuel pump 20 since check valve member 78 being held in the unseated position by valve spool 52 prevents pressurization of fuel by pumping plunger 34. It should be noted that the path to pump housing inlet passage 41 which enables the limp-home operation of high-pressure fuel pump 20 also enables the use of only one pressure-relief valve, i.e. pressure relief valve assembly 48.

Figure 5:
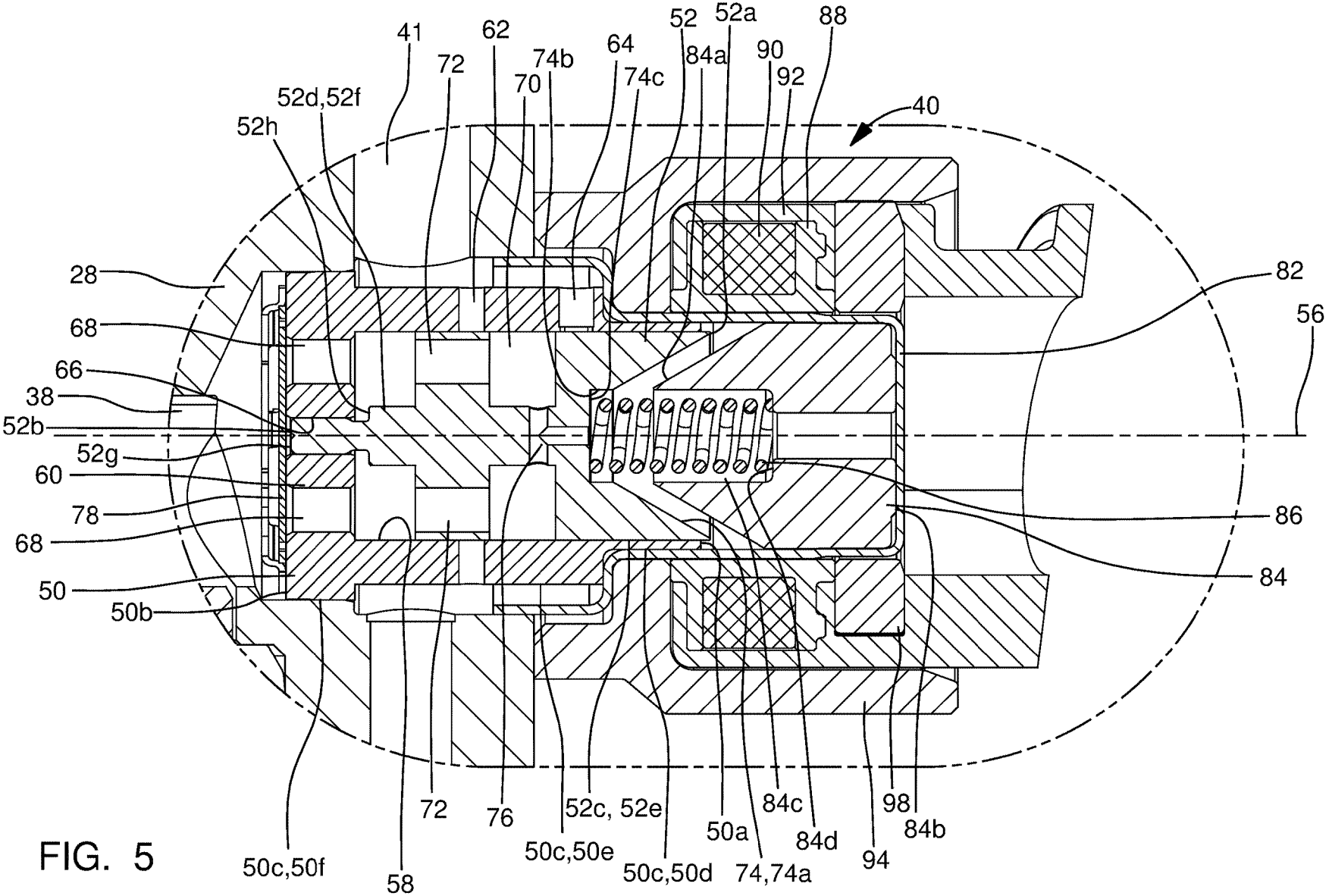
FIG. 5 is the view of FIG. 4, now showing the inlet valve assembly in a second position.

Now with particular reference to FIG. 5, valve spool 52 is shown in a second position which results from electric current being supplied to coil 90 of solenoid assembly 55 at a first duty cycle. When electric current is supplied to coil 90 at the first duty cycle, valve spool 52 is attracted to pole piece 84, thereby moving valve spool 52 toward pole piece 84 and compressing return spring 86 to a greater extent than in the first position. Valve spool connecting passage 76 allows fuel located between valve spool 52 and pole piece 84 to be displaced toward valve body outlet passages 68 during movement of valve spool 52 toward pole piece 84 and also allows pressure to equalize on each axial end of valve spool 52. In the second position, tip portion 52*g* is positioned to no longer protrude beyond valve body second end 50*b*, and consequently, check valve member 78 is moved to a seated position which prevents flow into valve body bore 58 through valve body outlet passages 68. Also in the second position, valve spool groove 70 is not aligned with valve body first inlet passage 62 and is also not aligned with valve body second inlet passage 64, and in this way, fuel is prevented from entering or exiting valve body bore 58 through valve body first inlet passage 62 and valve body second inlet passage 64. Consequently, valve body first inlet passage 62 and valve body second inlet passage 64 is not in fluid communication with valve body outlet passages 68.

The second position of valve spool 52 is used when internal combustion engine 12 is in operation but is not requesting fuel to be supplied from fuel injectors 16 as may occur during a fuel deceleration cutoff event when an automobile is coasting and no fuel is being commanded. In this way, the second position prevents fuel from being supplied to fuel injectors 16.

Figure 6:
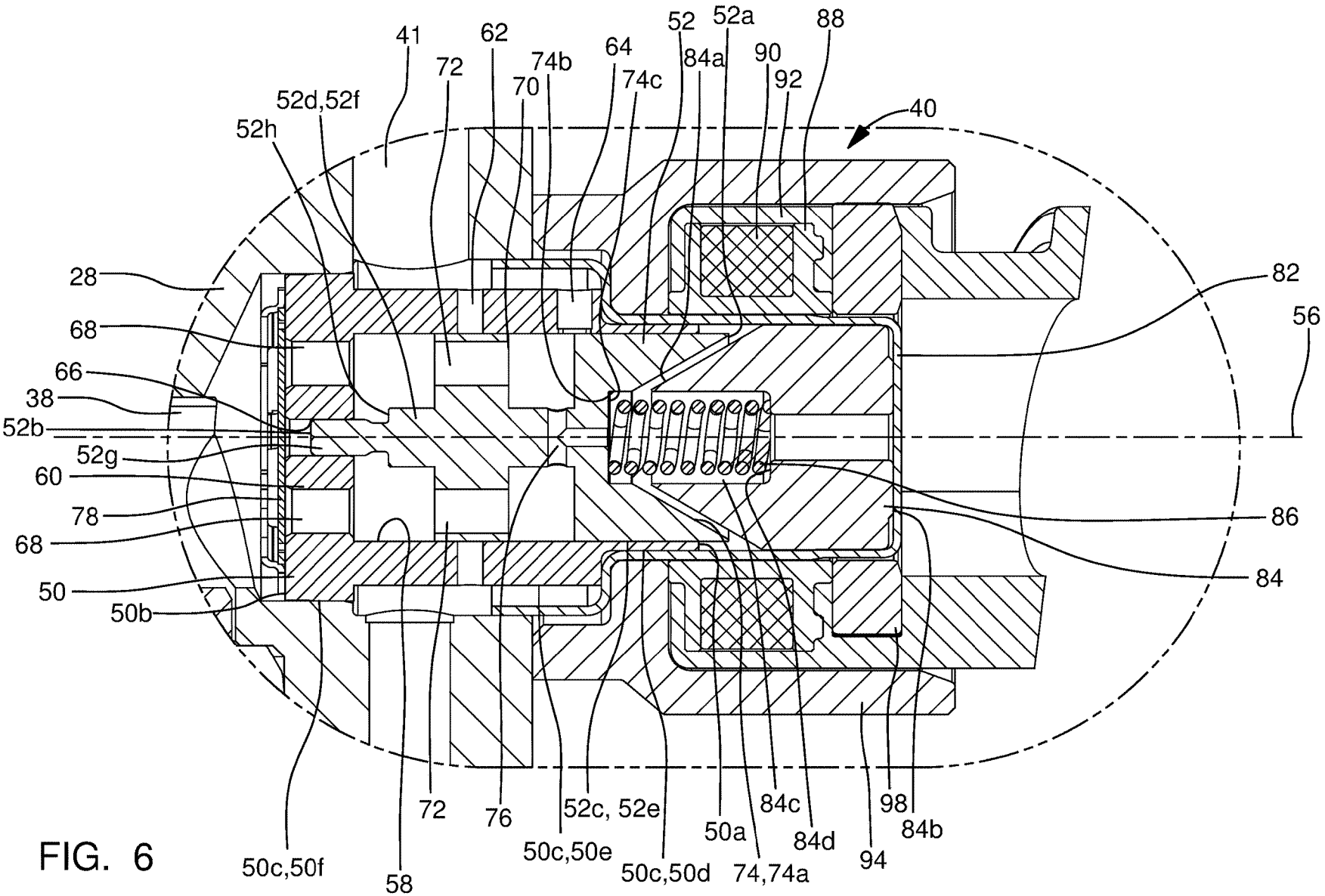
FIG. 6 is the view of FIGS. 4 and 5, now showing the inlet valve assembly in a third position.

Now with particular reference to FIG. 6, valve spool 52 is shown in a third position which results from electric current being supplied to coil 90 of solenoid assembly 55 at a second duty cycle which is greater than the first duty cycle used to achieve the second position of valve spool 52. When electric current is supplied to coil 90 at the second duty cycle, valve spool 52 is attracted to pole piece 84, thereby moving valve spool 52 toward pole piece 84 and compressing return spring 86 to a greater extent than in the second position. Just as in the second position, the third position results in tip portion 52*g* being positioned to no longer protrude beyond valve body second end 50*b*, and consequently, check valve member 78 is moved to a seated position which prevents flow into valve body bore 58 through valve body outlet passages 68. However, it should be noted that check valve member 78 is able to move to the unseated position when the pressure differential between valve body bore 58 and pumping chamber 38 is sufficiently high, i.e. during the intake stroke. Also in the third position, valve spool groove 70 is not aligned with valve body first inlet passage 62, however, valve spool groove 70 is now aligned with valve body second inlet passage 64, and in this way, fuel is allowed to valve body bore 58 through valve body second inlet passage 64. Consequently, during the intake stroke of pumping plunger 34, a pressure differential is created which allows fuel to flow through inlet valve assembly 40 through valve body second inlet passage 64, thereby moving check valve member 78 to the unseated position which allows fuel to flow into pumping chamber 38. During the compression stroke of pumping plunger 34, pressure increases within pumping chamber 38, thereby causing check valve member 78 to move to the seated position which prevents fuel from flowing from pumping chamber 38 into valve body bore 58 and which allows the pressurized fuel within pumping chamber 38 to be discharged through combination outlet valve and pressure relief valve 42. The third position of valve spool 52 is used when internal combustion engine 12 is required to produce a light output torque since it is noted that alignment of valve spool groove 70 with valve body second inlet passage 64 provides a restricted passage which thereby meters a small amount of fuel to pumping chamber 38 during the intake stroke of pumping plunger 34 to support fueling of internal combustion engine 12 at light loads.

Figure 7:
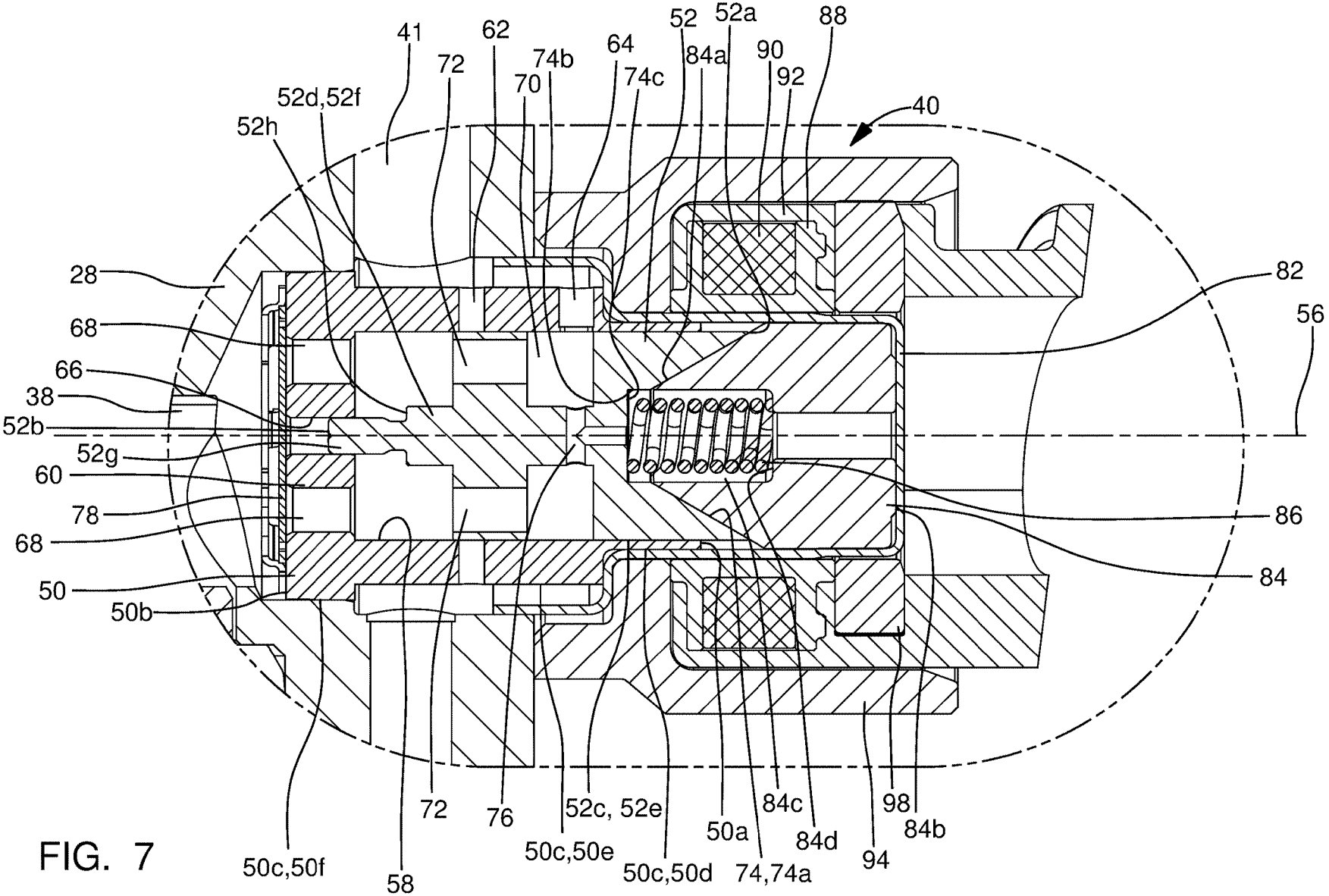
FIG. 7 is the view of FIGS. 4-6, now showing the inlet valve assembly in a fourth position.
Figure 8:
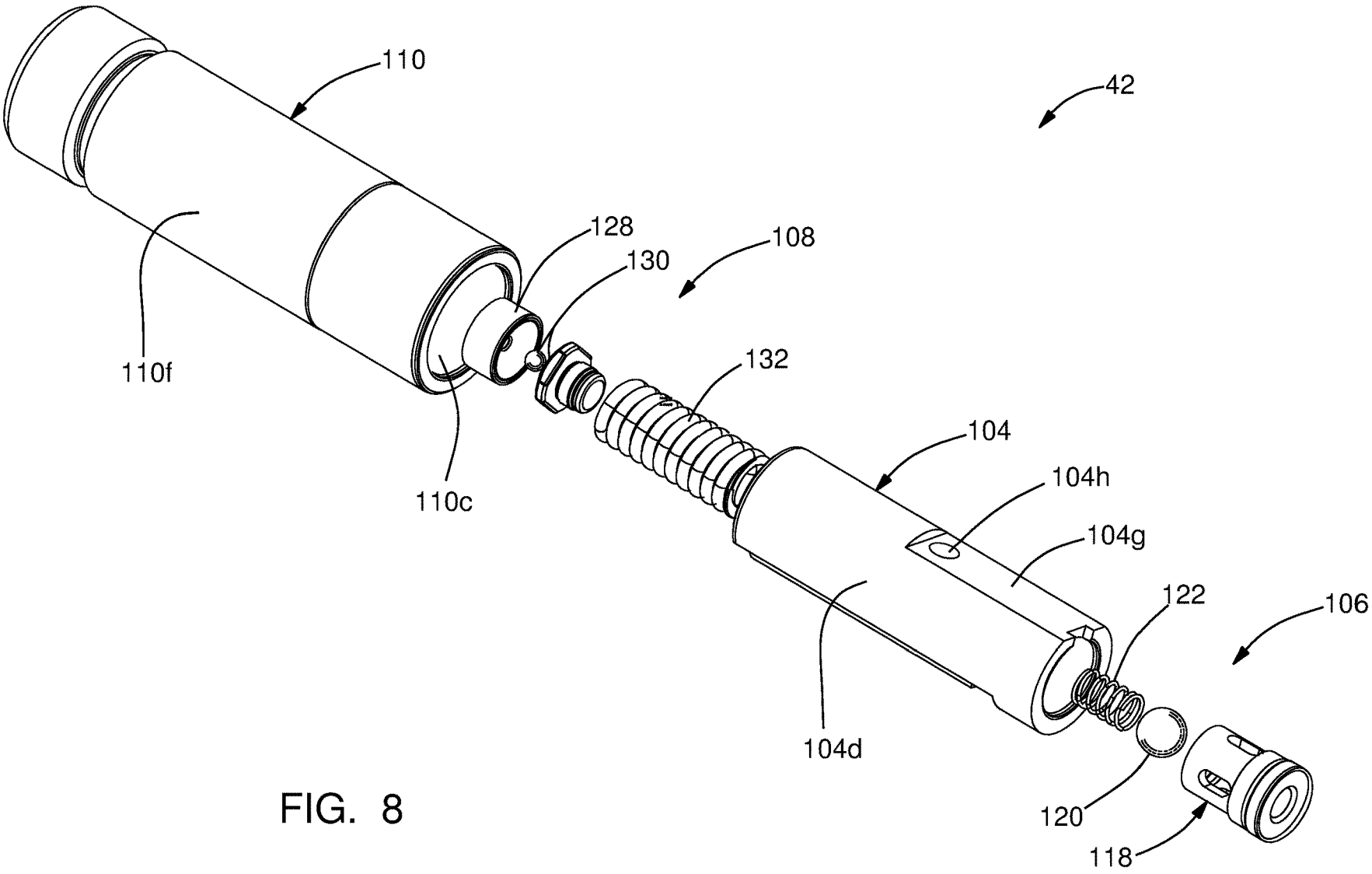
FIG. 8 is an isometric exploded view of a combination outlet valve and pressure relief valve of the fuel pump of FIGS. 1 and 2.

Now with particular reference to FIG. 7, valve spool 52 is shown in a fourth position which results from electric current being supplied to coil 90 of solenoid assembly 55 at a third duty cycle which is greater than the second duty cycle used to achieve the third position of valve spool 52. When electric current is supplied to coil 90 at the third duty cycle, valve spool 52 is attracted to pole piece 84, thereby moving valve spool 52 toward pole piece 84 and compressing return spring 86 to a greater extent than in the third position. Just as in the second and third positions, the fourth position results in tip portion 52*g* being positioned to no longer protrude beyond valve body second end 50*b*, and consequently, check valve member 78 is moved to a seated position which prevents flow into valve body bore 58 through valve body outlet passages 68. However, it should be noted that check valve member 78 is able to move to the unseated position when the pressure differential between valve body bore 58 and pumping chamber 38 is sufficiently high, i.e. during the intake stroke. Also in the fourth position, just as in the third position, valve spool groove 70 is not aligned with valve body first inlet passage 62, however, valve spool groove 70 is now aligned with valve body second inlet passage 64, and in this way, fuel is allowed to valve body bore 58 through valve body second inlet passage 64. Consequently, during the intake stroke of pumping plunger 34, a pressure differential is created which allows fuel to flow through inlet valve assembly 40 through valve body second inlet passage 64, thereby moving check valve member 78 to the unseated position which allows fuel to flow into pumping chamber 38. During the compression stroke of pumping plunger 34, pressure increases within pumping chamber 38, thereby causing check valve member 78 to move to the seated position which prevents fuel from flowing from pumping chamber 38 into valve body bore 58 and which allows the pressurized fuel within pumping chamber 38 to be discharged through combination outlet valve and pressure relief valve 42. As should now be apparent, the third and fourth positions of valve spool 52 are nearly identical, however, the fourth position differs from the third position in that the alignment of valve spool groove 70 with valve body second inlet passage 64 is less restrictive than in the third position. Consequently, the fourth position of valve spool 52 is used when internal combustion engine 12 is required to produce a higher output torque since the alignment of valve spool groove 70 with valve body second inlet passage 64 provides a less restrictive passage which thereby meters a larger amount of fuel, compared to the third position, to pumping chamber 38 during the intake stroke of pumping plunger 34 to support fueling of internal combustion engine 12 at high loads.

As should now be clear, different duty cycles can be provided to vary the amount of fuel metered to pumping chamber 38 where the different duty cycles result in varying magnitudes of alignment of valve spool groove 70 with valve body second inlet passage 64, thereby varying the magnitude of restriction. In other words, the third and fourth positions as described above are only examples of positions of valve spool 52, and other duty cycles can be provided in order to provide different metered amounts of fuel to pumping chamber 38 in order to achieve different output torques of internal combustion engine 12. An electronic control unit 100 may be used to supply electric current to coil 90 at the various duty cycles described herein. Electronic control unit 100 may receive input from a pressure sensor 102 which senses the pressure within fuel rail 44 in order to provide a proper duty cycle to coil 90 in order to maintain a desired pressure in fuel rail 44 which may vary based on the commanded torque desired to be produced by internal combustion engine 12.

Combination outlet valve and pressure relief valve 42 will now be described with particular reference to FIGS. 8-11. Combination outlet valve and pressure relief valve 42 includes an inner housing 104, an outlet valve assembly 106, a pressure relief valve assembly 108, and an outer housing 110. The various elements of combination outlet valve and pressure relief valve 42 will be described in greater detail in the paragraphs that follow.

Inner housing 104 extends along an inner housing axis 112 from an inner housing first end face 104*a* to an inner housing second end face 104*b*. An outlet valve bore 114 extends into inner housing 104 from inner housing first end face 104*a* while a pressure relief valve bore 116 extends into inner housing 104 from inner housing second end face 104*b*. Outlet valve bore 114 and pressure relief valve bore 116 are each terminated by an inner housing wall 104*c* which is travers to inner housing axis 112 and preferably fluidly isolates outlet valve bore 114 from pressure relief valve bore 116 internal to inner housing 104 as illustrated in the figures. Inner housing wall 104*c* is preferably integrally formed as a single piece with inner housing 104. Outlet valve bore 114 may be stepped as shown, thereby defining an outlet valve spring pocket 114*a* which is smaller in diameter than the remainder of outlet valve bore 114 such that outlet valve spring pocket 114*a* extends into inner housing wall 104*c*. A projection 116*a* may extend within pressure relief valve bore 116 from inner housing wall 104*c* such that projection 116*a* is centered about, and extends along, inner housing axis 112, thereby forming a pressure relief spring pocket 116*b* which is annular in shape. Projection 116*a* is preferably integrally formed as a single piece with inner housing 104. Inner housing 104 includes an inner housing outer periphery 104*d* which surrounds inner housing axis 112 and is cylindrical in shape. Extending into inner housing outer periphery 104*d* is one or more channels 104*e* which extend from inner housing second end face 104*b* toward inner housing first end face 104*a*, however, channels 104*e* do not extend all the way to inner housing first end face 104*a*. An outlet aperture 104*f* extends radially through inner housing 104 from outlet valve bore 114 to channels 104*e*. Channels 104*e* and outlet aperture 104*f* together define an outlet passage, the function of which will be described in greater detail later. Extending into inner housing outer periphery 104*d* is a flat 104*g* which extends from inner housing first end face 104*a* toward inner housing second end face 104*b*, however, flat 104*g* does not extend all the way to inner housing second end face 104*b*. A pressure relief aperture 104*h* extends radially through inner housing 104 from pressure relief valve bore 116 to flat 104*g*. Flat 104*g* and pressure relief aperture 104*h* together define a pressure relief passage, the function of which will be described in greater detail later.

Outer housing 110 extends along inner housing axis 112 from an outer housing first end face 110*a*, which is proximal to pumping chamber 38, to an outer housing second end face 110*b*, which is distal from pumping chamber 38. An outer housing passage 110*c* extends therethrough from an outer housing inlet 110*d* to an outer housing outlet 110*e* such that outer housing inlet 110*d* opens into outer housing first end face 110*a* and such that outer housing outlet 110*e* opens into outer housing second end face 110*b*. Outer housing passage 110*c* is centered about inner housing axis 112 and is cylindrical in shape, preferably sized to engage inner housing outer periphery 104*d* in an interference fit relationship, thereby preventing fuel from passing between the mating surfaces, i.e. inner housing outer periphery 104*d* and outer housing passage 110*c*. Inner housing 104 is located within outer housing passage 110*c* such that channels 104*e* and outlet aperture 104*f* of inner housing 104 are located within outer housing passage 110*c*, thereby defining an outlet passage located radially between inner housing 104 and outer housing 110. Similarly, flat 104*g* and pressure relief aperture 104*h* of inner housing 104 are located within outer housing passage 110*c*, thereby defining a pressure relief passage located radially between inner housing 104 and outer housing 110. Outer housing 110 includes an outer housing outer periphery 110*f* which surrounds, and is preferably cylindrical and centered about, inner housing axis 112. As is best seen in FIG. 2, a portion of outer housing outer periphery 110*f* is received with a portion of housing outlet passage 43, preferably in an interference fit which prevents fuel from passing between the interface of outer housing outer periphery 110*f* and housing outlet passage 43. Furthermore, the portion of outer housing outer periphery 110*f* that is not located within housing outlet passage 43 may serve as a point of connection to a fuel line, shown only schematically in FIG. 1, which is connected to fuel rail 44.

Outlet valve assembly 106 includes an outlet valve seat 118, an outlet valve member 120, and an outlet valve spring 122. Outlet valve seat 118 is located within outlet valve bore 114 of inner housing 104 and includes an outlet valve seat bore 118*a* extending therethrough such that outlet valve seat bore 118*a* is centered about, and extends along, inner housing axis 112. Outlet valve seat bore 118*a* is stepped, thereby defining an outlet valve seating surface 118*b* which faces toward inner housing wall 104*c*. A portion of the outer periphery of outlet valve seat 118 proximal to inner housing first end face 104*a* is sealed to outlet valve bore 114, by way of non-limiting example, by interference fit. One or more outlet valve seat passages 118*c* extend radially through outlet valve seat 118 from outlet valve seat bore 118*a* to the outer periphery of outlet valve seat 118 at a location that is downstream of outlet valve seating surface 118*b* such that outlet valve seat passages 118*c* are in fluid communication with outlet aperture 104*f* and channels 104*e*.

Figure 9:
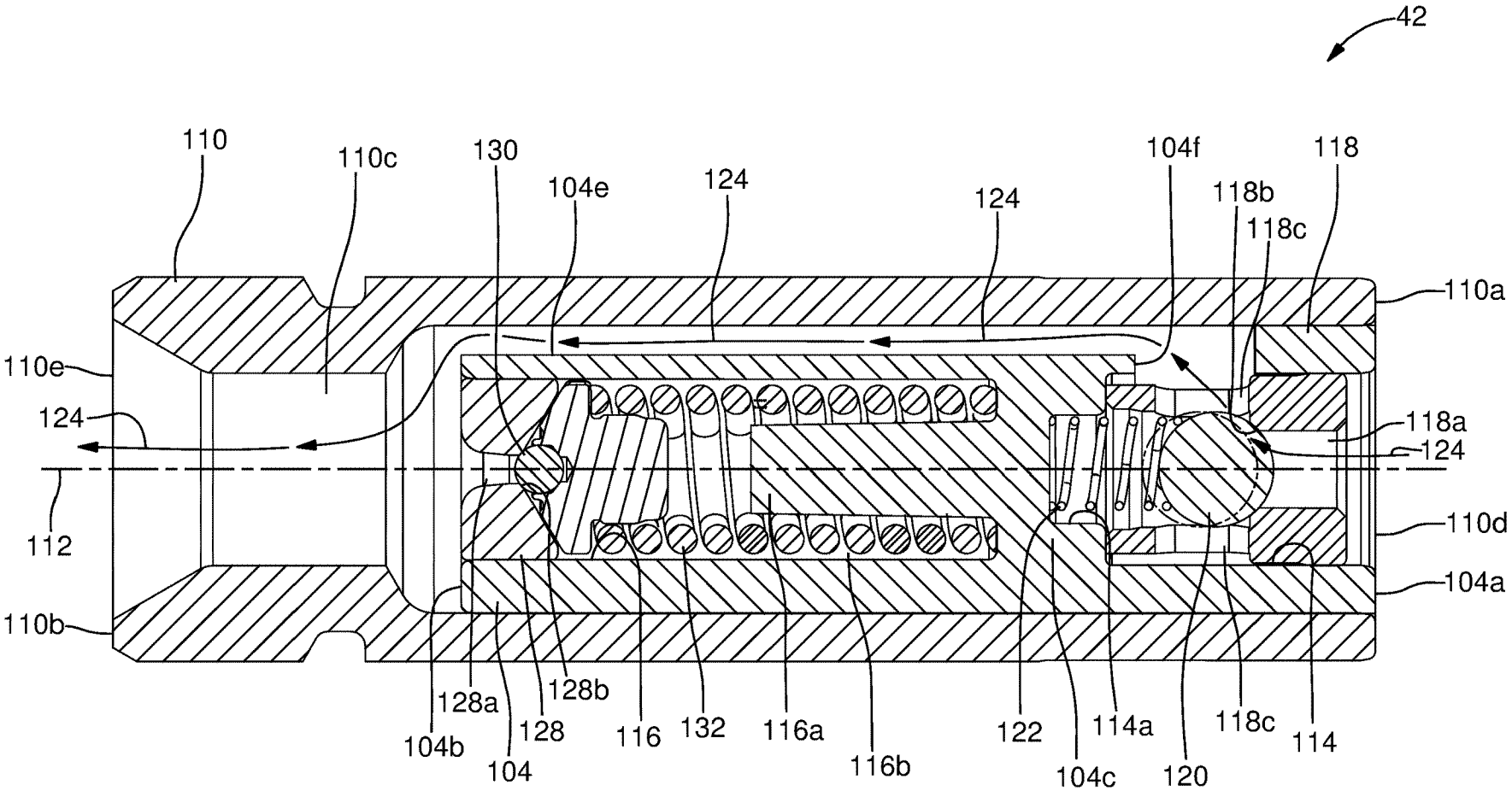
FIG. 9 is an axial cross-sectional view of the combination outlet valve and pressure relief valve of FIG. 8.

Outlet valve member 120, illustrated herein as a ball by way of non-limiting example only, is moveable between 1) a seated position which prevents fluid communication between outer housing inlet 110*d* and outer housing outlet 110*e* via outlet valve assembly 106 and 2) an unseated position which permits fluid communication between outer housing inlet 110*d* and outer housing outlet 110*e* via outlet valve assembly 106. One end of outlet valve spring 122 is located within outlet valve spring pocket 114*a* and is grounded to inner housing wall 104*c* while the other end of outlet valve spring 122 engages outlet valve member 120, thereby biasing outlet valve member 120 toward the seated position which is in a direction away from pressure relief valve assembly 108. It should be noted that FIG. 9 illustrates outlet valve member 120 in the seated position using solid lines and in the unseated position using phantom lines. During operation, when fuel is pressurized in pumping chamber 38, the pressurized fuel urges outlet valve member 120 to further compress outlet valve spring 122, thereby allowing fuel to flow from pumping chamber 38 to fuel rail 44 via outer housing inlet 110*d*, outlet valve seat bore 118*a*, outlet valve seat passages 118*c*, outlet aperture 104*f*, channels 104*e*, and outer housing passage 110*c*. However, when conditions cause the pressure downstream of outlet valve seat 118 to be greater than the pressure upstream of outlet valve seat 118, outlet valve member 120 is moved back to the seated position. For clarity, arrows 124 are provided in FIG. 9 to illustrate this path of flow when outlet valve member 120 is unseated, where it is noted that only select arrows 124 have been labeled.

Pressure relief valve assembly 108 includes a pressure relief valve seat 128, a pressure relief valve member 130, and a pressure relief valve spring 132. Pressure relief valve seat 128 is located within pressure relief valve bore 116 of inner housing 104 and includes a pressure relief valve seat bore 128*a* extending therethrough such that pressure relief valve seat bore 128*a* is centered about, and extends along, inner housing axis 112. Pressure relief valve seat bore 128*a* defines a pressure relief valve seating surface 128*b* which faces toward inner housing wall 104*c*. The outer periphery of pressure relief valve seat 128 is sealed to pressure relief valve bore 116, by way of non-limiting example, by interference fit.

Figure 10:
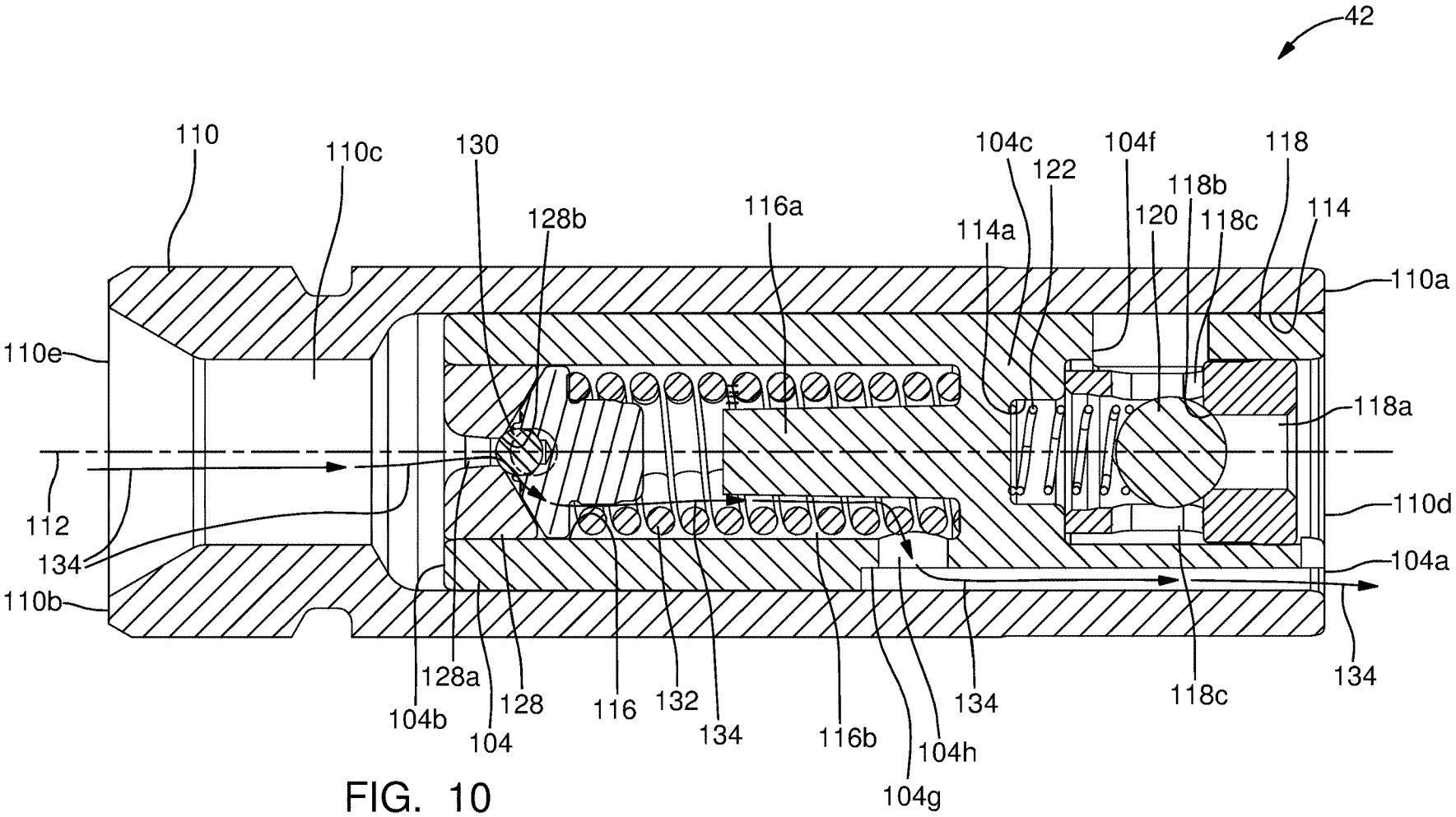
FIG. 10 is an axial cross-sectional view of the combination outlet valve and pressure relief valve of FIG. 8, taken in a different rotational position compared to FIG. 9.
Figure 11:
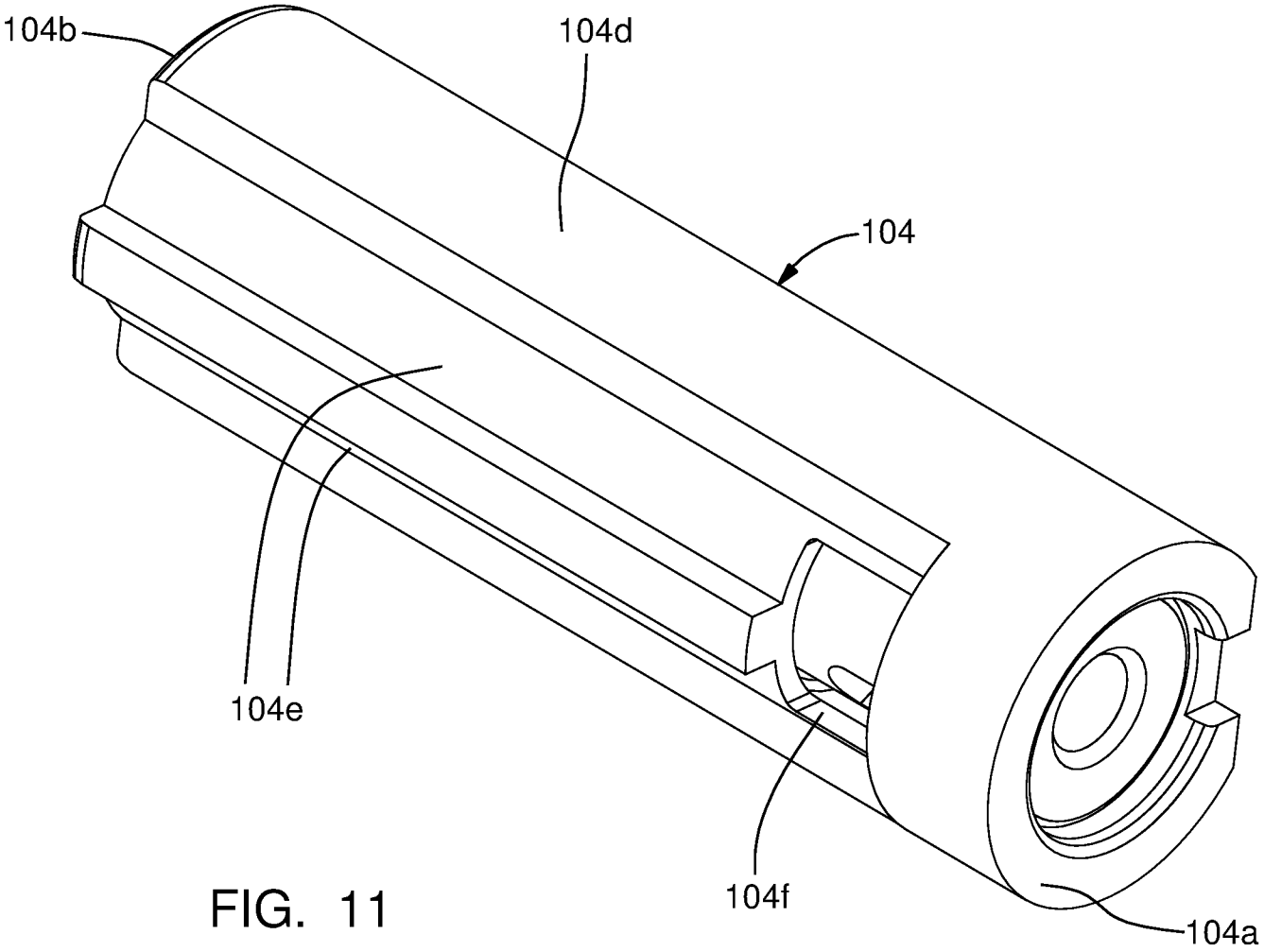
FIG. 11 is an isometric view of the combination outlet valve and pressure relief valve.

Pressure relief valve member 130, illustrated herein as a ball and ball holder by way of non-limiting example only, is moveable between 1) a seated position which prevents fluid communication between outer housing inlet 110*d* and outer housing outlet 110*e* via pressure relief valve assembly 108 and 2) an unseated position which permits fluid communication between outer housing inlet 110*d* and outer housing outlet 110*e* via pressure relief valve assembly 108. One end of pressure relief valve spring 132 is located within pressure relief spring pocket 116*b* and is grounded to inner housing wall 104*c* while the other end of pressure relief valve spring 132 engages pressure relief valve member 130, thereby biasing pressure relief valve member 130 toward the seated position which is in a direction away from outlet valve assembly 106. Pressure relief valve spring 132 is selected to have a desired spring rate, and pressure relief valve seat 128 is inserted sufficiently far into pressure relief valve bore 116, to achieve a desired force required to move pressure relief valve member 130 to the unseated position where this desired force is based on system requirements limiting pressure downstream of high-pressure fuel pump 20 that would be known to a person of ordinary skill in the art through strength and operating characteristics of fuel system 10. It should be noted that FIG. 10 illustrates pressure relief valve member 130 in the seated position using solid lines and in the unseated position (ball portion only) using phantom lines. During operation, if pressure upstream of pressure relief valve seat 128, i.e. in a direction toward fuel rail 44, exceeds a predetermined pressure, the pressurized fuel urges the pressure relief valve member 130 to further compress pressure relief valve spring 132, thereby unseating pressure relief valve member 130 and allowing fuel to flow in a direction from fuel rail 44 to pumping chamber 38 via outer housing passage 110*c*, pressure relief valve seat bore 128*a*, pressure relief valve bore 116, pressure relief spring pocket 116*b*, pressure relief aperture 104*h*, and the space radially between flat 104*g*, and outer housing passage 110*c*. For clarity, arrows 124 are provided in FIG. 10 to illustrate this path of flow when pressure relief valve member 130 is unseated.

Combination outlet valve and pressure relief valve 42 as described herein provides a common ground for outlet valve spring 122 and pressure relief valve spring 132. This arrangement may make inner housing 104 particularly well suited for manufacture by metal injection molding (MIM) which is desirable for efficient and cost effective manufacture. Additionally, one or more of outlet valve seat 118 and pressure relief valve seat 128 may be able to be utilized from existing designs taken from arrangements where the outlet valve and the pressure relief valve are not combined into one device. This eliminates the need for specialized seats which would add cost and complexity.

While high-pressure fuel pump 20 has been illustrated in the figures as including pressure pulsation dampers upstream of pump housing inlet passage 41, although not described herein, it should be understood that the pressure pulsation dampers may be omitted as a result of employing inlet valve assembly 40 which is a proportional valve. Furthermore, while check valve member 78 has been illustrated herein as a flat plate, it should be understood that check valve member 78 may alternatively be a ball biased by a spring which opens and closes a single valve body outlet passage 68.

While this invention has been described in terms of preferred embodiments thereof, it is not intended to be so limited, but rather only to the extent set forth in the claims that follow.

We claim:

1. A combination outlet valve and pressure relief valve for controlling outlet fuel flow of a fuel pump and for relieving over-pressurization downstream of said fuel pump, said combination outlet valve and pressure relief comprising:

an outer housing having an outer housing passage extending therethrough from an outer housing inlet to an outer housing outlet;

an inner housing located within said outer housing passage and extending along an inner housing axis from an inner housing first end face to an inner housing second end face, said inner housing having an outlet valve bore extending thereinto from said inner housing first end face and also having a pressure relief valve bore extending thereinto from said inner housing second end face such that said outlet valve bore and said pressure relief valve bore terminate at an inner housing wall which is traverse to said inner housing axis;

an outlet valve assembly comprising an outlet valve member located within said outlet valve bore, an outlet valve seat located within said outlet valve bore, and an outlet valve spring located within said outlet valve bore, said outlet valve member being moveable between 1) a seated position which prevents fluid communication between said outer housing inlet and said outer housing outlet through said outlet valve bore by way of said outlet valve seat and 2) an unseated position which permits fluid communication between said outer housing inlet and said outer housing outlet through said outlet valve bore by way of said outlet valve seat, said outlet valve spring being grounded to said inner housing wall and biasing said outlet valve member toward said seated position; and a pressure relief valve assembly and comprising a pressure relief valve member located within said pressure relief valve bore, a pressure relief valve seat located within said pressure relief valve bore, and a pressure relief valve spring located within said pressure relief valve bore, said pressure relief valve member being moveable between 1) a seated position which prevents fluid communication between said outer housing outlet and said outer housing inlet through said pressure relief valve bore by way of said pressure relief valve seat and 2) an unseated position which permits fluid communication between said outer housing outlet and said outer housing inlet through said pressure relief valve bore by way of said pressure relief valve seat, said pressure relief valve spring being grounded to said inner housing wall and biasing said pressure relief valve member toward said seated position.

2. A combination outlet valve and pressure relief valve as in claim 1, wherein said unseated position of said outlet valve member while said pressure relief valve member is simultaneously in said seated position provides fluid communication from said outer housing inlet to said outer housing outlet through said outlet valve bore by way of said outlet valve seat and wherein said unseated position of said pressure relief valve member while said outlet valve member is simultaneously in said seated position provides fluid communication from said outer housing outlet to said outer housing inlet through said pressure relief valve bore by way of said pressure relief valve seat.

3. A combination outlet valve and pressure relief valve as in claim 1 further comprising an outlet passage through which fluid flows from said outlet valve bore to said outer housing outlet after passing through said outlet valve seat when said outlet valve member is in said unseated position, said outlet passage being located radially between said inner housing and said outer housing such that said outlet passage extends to said inner housing second end face.

4. A combination outlet valve and pressure relief valve as in claim 3, wherein said outlet passage comprises a channel recessed in an outer periphery of said inner housing.

5. A combination outlet valve and pressure relief valve as in claim 4, wherein said outlet passage further comprises an outlet aperture extending radially through said inner housing from said outlet valve bore to said channel such that said outlet aperture provides fluid communication from said outlet valve bore to said channel.

6. A combination outlet valve and pressure relief valve as in claim 1 further comprising a pressure relief passage through which fluid flows from said pressure relief valve bore to said outer housing inlet after passing through said pressure relief valve seat when said pressure relief valve member is in said unseated position, said pressure relief passage being located radially between said inner housing and said outer housing such that said pressure relief passage extends to said inner housing first end face.

7. A combination outlet valve and pressure relief valve as in claim 6, wherein said pressure relief passage comprises a flat in an outer periphery of said inner housing.

8. A combination outlet valve and pressure relief valve as in claim 7, wherein said pressure relief passage further comprises a pressure relief aperture extending radially through said inner housing from said pressure relief valve bore to said flat such that said pressure relief aperture provides fluid communication from said pressure relief valve bore to said flat.

9. A combination outlet valve and pressure relief valve as in claim 1, wherein said outlet valve spring biases said outlet valve member in a direction away from said pressure relief valve assembly.

10. A combination outlet valve and pressure relief valve as in claim 1, wherein said pressure relief valve spring biases said outlet valve member in a direction away from said outlet valve assembly.

11. A fuel pump comprising:

a fuel pump housing with a pumping chamber defined therein;

a pumping plunger which reciprocates within a plunger bore along a plunger bore axis such that an intake stroke of said pumping plunger increases volume of said pumping chamber and a compression stroke of said pumping plunger decreases volume of said pumping chamber; and a combination outlet valve and pressure relief valve for controlling outlet fuel flow of said fuel pump and for relieving over-pressurization downstream of said fuel pump, said combination outlet valve and pressure relief comprising:

an outer housing having an outer housing passage extending therethrough from an outer housing inlet to an outer housing outlet;

an inner housing located within said outer housing passage and extending along an inner housing axis from an inner housing first end face to an inner housing second end face, said inner housing having an outlet valve bore extending thereinto from said inner housing first end face and also having a pressure relief valve bore extending thereinto from said inner housing second end face such that said outlet valve bore and said pressure relief valve bore terminate at an inner housing wall which is traverse to said inner housing axis;

an outlet valve assembly comprising an outlet valve member located within said outlet valve bore, an outlet valve seat located within said outlet valve bore, and an outlet valve spring located within said outlet valve bore, said outlet valve member being moveable between 1) a seated position which prevents fluid communication between said outer housing inlet and said outer housing outlet through said outlet valve bore by way of said outlet valve seat and 2) an unseated position which permits fluid communication between said outer housing inlet and said outer housing outlet through said outlet valve bore by way of said outlet valve seat, said outlet valve spring being grounded to said inner housing wall and biasing said outlet valve member toward said seated position; and a pressure relief valve assembly and comprising a pressure relief valve member located within said pressure valve bore, a pressure relief valve seat located within said pressure relief valve bore, and a pressure relief valve spring located within said outlet valve bore, said pressure relief valve member being moveable between 1) a seated position which prevents fluid communication between said outer housing outlet and said outer housing inlet through said pressure relief valve bore by way of said pressure relief valve seat and 2) an unseated position which permits fluid communication between said outer housing outlet and said outer housing inlet through said pressure relief valve bore by way of said pressure relief valve seat, said pressure relief valve spring being grounded to said inner housing wall and biasing said pressure relief valve member toward said seated position.

12. A fuel pump as in claim 11, wherein said unseated position of said outlet valve member while said pressure relief valve member is simultaneously in said seated position provides fluid communication from said outer housing inlet to said outer housing outlet through said outlet valve bore by way of said outlet valve seat and wherein said unseated position of said pressure relief valve member while said outlet valve member is simultaneously in said seated position provides fluid communication from said outer housing outlet to said outer housing inlet through said pressure relief valve bore by way of said pressure relief valve seat.

13. A fuel pump as in claim 11 further comprising an outlet passage located through which fluid flows from said outlet valve bore to said outer housing outlet after passing through said outlet valve seat when said outlet valve member is in said unseated position said outlet passage being located radially between said inner housing and said outer housing such that said outlet passage extends to said inner housing second end face.

14. A fuel pump as in claim 13, wherein said outlet passage comprises a channel recessed in an outer periphery of said inner housing.

15. A fuel pump as in claim 14, wherein said outlet passage further comprises an outlet aperture extending radially through said inner housing from said outlet valve bore to said channel such that said outlet aperture provides fluid communication from said outlet valve bore to said channel.

16. A fuel pump as in claim 11 further comprising a pressure relief passage through which fluid flows from said pressure relief valve bore to said outer housing inlet after passing through said pressure relief valve seat when said pressure relief valve member is in said unseated position, said pressure relief passage being located radially between said inner housing and said outer housing such that said pressure relief passage extends to said inner housing first end face.

17. A fuel pump as in claim 16, wherein said pressure relief passage comprises a flat in an outer periphery of said inner housing.

18. A fuel pump as in claim 17, wherein said pressure relief passage further comprises a pressure relief aperture extending radially through said inner housing from said pressure relief valve bore to said flat such that said pressure relief aperture provides fluid communication from said pressure relief valve bore to said flat.

19. A fuel pump as in claim 11, wherein said outlet valve spring biases said outlet valve member in a direction away from said pressure relief valve assembly.

20. A fuel pump as in claim 11, wherein said pressure relief valve spring biases said outlet valve member in a direction away from said outlet valve assembly.

* * * * *